US010106302B1

(12) United States Patent
Sorby et al.

(10) Patent No.: US 10,106,302 B1
(45) Date of Patent: Oct. 23, 2018

(54) BEVERAGE CONTAINER POURING CAP

(71) Applicants: Christy F. Sorby, Byron, MI (US); John K. Sorby, Byron, MI (US)

(72) Inventors: Christy F. Sorby, Byron, MI (US); John K. Sorby, Byron, MI (US)

( * ) Notice: Subject to any disclaimer, the term of this patent is extended or adjusted under 35 U.S.C. 154(b) by 48 days.

(21) Appl. No.: 15/049,522

(22) Filed: Feb. 22, 2016

Related U.S. Application Data

(60) Provisional application No. 62/118,709, filed on Feb. 20, 2015.

(51) Int. Cl.

| | |
|---|---|
| ***B65D 49/04*** | (2006.01) |
| ***B65D 51/16*** | (2006.01) |
| ***B65D 51/18*** | (2006.01) |
| ***B65D 49/02*** | (2006.01) |

(52) U.S. Cl.
CPC ..... *B65D 49/04* (2013.01); *B65D 49/02* (2013.01); *B65D 51/1644* (2013.01); *B65D 51/18* (2013.01); *B65D 2251/009* (2013.01); *B65D 2251/0028* (2013.01)

(58) Field of Classification Search
CPC ..... B65D 51/1644; B65D 51/18; B65D 2251/009; B65D 2251/0028; B65D 49/02; B65D 49/04
USPC ..... 220/254.8; 215/21, 311, 315
See application file for complete search history.

(56) References Cited

U.S. PATENT DOCUMENTS

| | | | | |
|---|---|---|---|---|
| 3,057,500 | A * | 10/1962 | Fortuna | B65D 49/04 215/21 |
| 3,693,847 | A | 9/1972 | Gibson | |
| 4,043,473 | A * | 8/1977 | Webb | B65D 49/02 215/21 |
| 4,078,700 | A | 3/1978 | Hidding | |
| 5,037,015 | A | 8/1991 | Collins | |
| 5,111,978 | A * | 5/1992 | Mengeu | B65D 47/06 215/321 |
| 5,240,132 | A | 8/1993 | Tucker | |
| 5,332,112 | A * | 7/1994 | Blocker | A47G 19/12 215/230 |
| 5,873,478 | A | 2/1999 | Sullivan et al. | |
| 6,041,982 | A | 3/2000 | Cautereels et al. | |
| 6,053,366 | A | 4/2000 | Legué | |
| 6,609,624 | B2 | 8/2003 | Goto et al. | |
| 6,991,126 | B2 | 1/2006 | Jäckel | |
| 7,686,188 | B2 | 3/2010 | Stebick et al. | |
| 2002/0066714 | A1 * | 6/2002 | Mainquist | B65D 51/1633 215/261 |
| 2002/0179616 | A1 * | 12/2002 | Elder | B65D 5/747 220/714 |

(Continued)

*Primary Examiner* — James N Smalley
(74) *Attorney, Agent, or Firm* — Cramer Patent & Design, PLLC; Aaron R. Cramer

(57) ABSTRACT

A pouring cap for a container automatically opens to pour the contents when tilted, and automatically closes when pouring is complete. The cap is affixed to the container along a bottom portion and to a locking upper lid along a top portion. An internal valve is provided which is guided vertically within the cap which covers a plurality of pouring apertures. When the cap and container are upturned during pouring, the valve is displaced to uncover the pouring apertures. When the container is downturned following pouring, the valve moves downwardly to cover the pouring apertures. When the locking upper lid is installed, it biases the valve to securely cover the pouring apertures.

18 Claims, 4 Drawing Sheets

(56) References Cited

U.S. PATENT DOCUMENTS

| | | | | |
|---|---|---|---|---|
| 2010/0181348 | A1 | 7/2010 | DeJonge | |
| 2012/0160798 | A1 | 6/2012 | Acklam | |
| 2016/0031616 | A1* | 2/2016 | Rye | B65D 41/04 220/203.29 |

* cited by examiner

BEVERAGE CONTAINER POURING CAP

RELATED APPLICATIONS

The present invention was first described in and claims the benefit of U.S. Provisional Application No. 62/118,709, filed Feb. 20, 2015, the entire disclosures of which are incorporated herein by reference.

FIELD OF THE INVENTION

The present invention relates generally to a cap for a container that opens to dispense contents within the container when the container is tilted.

BACKGROUND OF THE INVENTION

Dispensing liquids out of containers can be a messy and complicated process when using one (1) hand, which is why using two (2) hands is typically the preferred process. When dispensing in this fashion, the sealing cap that protects the liquid contents therein from spilling out must first be removed. Then, the cap must be held or placed in close vicinity to later be replaced on the opening of the container once dispensing is complete. These steps create a longer and more complicated process for dispensing the liquid contents of a container for subsequent use or consumption.

Hence, the inventors have seen a need for a cap that can be used on common dispensing containers such as beverage one Liter (1 L) or two Liter (2 L) bottle than allows for a simple means to dispense when the container is tipped over and to close when the container is uprighted.

SUMMARY OF THE INVENTION

The principles of the present invention provide for a cap for a container that opens to dispense contents within the container when the container is tilted and to close when the container is uprighted.

It is therefore an object of the invention to provide a cap, comprising a lower lid assembly adapted to attach to and be in fluid communication with a container opening and an upper lid assembly attachable to and in fluid communication with the lower lid assembly. Once the lower lid assembly is attached to the container opening, the lower lid assembly permits the dispensing of the contents within the container when the container is in a tilted position and it closes when the container is returned to an upright position. Both upper and lower lid assemblies may be made of plastic.

The lower lid assembly further comprises a lower lid body, a sealing panel and a valve. The sealing panel bisects the lower lid body defining an upper space and a lower space. The sealing panel also has a plurality of apertures which provides fluid communication between the upper space and the lower space. The valve is located within the upper space and is able to be actuated between a closed position covering the plurality of apertures and an open position which enables fluid communication through the plurality of apertures. The lower space receives the container opening. The plurality of apertures may be arranged along a circular pattern being equally spaced.

The valve further comprises a guide pin and a centrally located guide pin aperture. The guide pin has a lower stop portion perpendicularly attached to a center of the sealing panel and an upper stop portion. The centrally located guide pin aperture permits the valve to travel along the length of the guide pin. When the lower lid assembly is attached to the container and the container is tilted downward, the valve is biased away from the sealing panel, thereby uncovering the plurality of apertures and permitting fluid communication between the container and the upper space. Inversely, when the lower lid assembly is attached to the container and the container is tilted upward, the valve entirely covers the plurality of apertures, thereby preventing fluid communication between the container and the upper space. The upper stop portion of the guide pin may be mushroom shaped.

The upper lid assembly further comprises an upper lid body and an appendage centrally located on the underside of the upper lid body. When the upper lid assembly is fully attached to the lower lid assembly, the appendage is in mechanical communication with a top surface of the valve thereby sealing the valve in a fixed state over the plurality of apertures. The valve may be dome-shaped. The appendage may be an integrally molded portion of the upper lid assembly.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
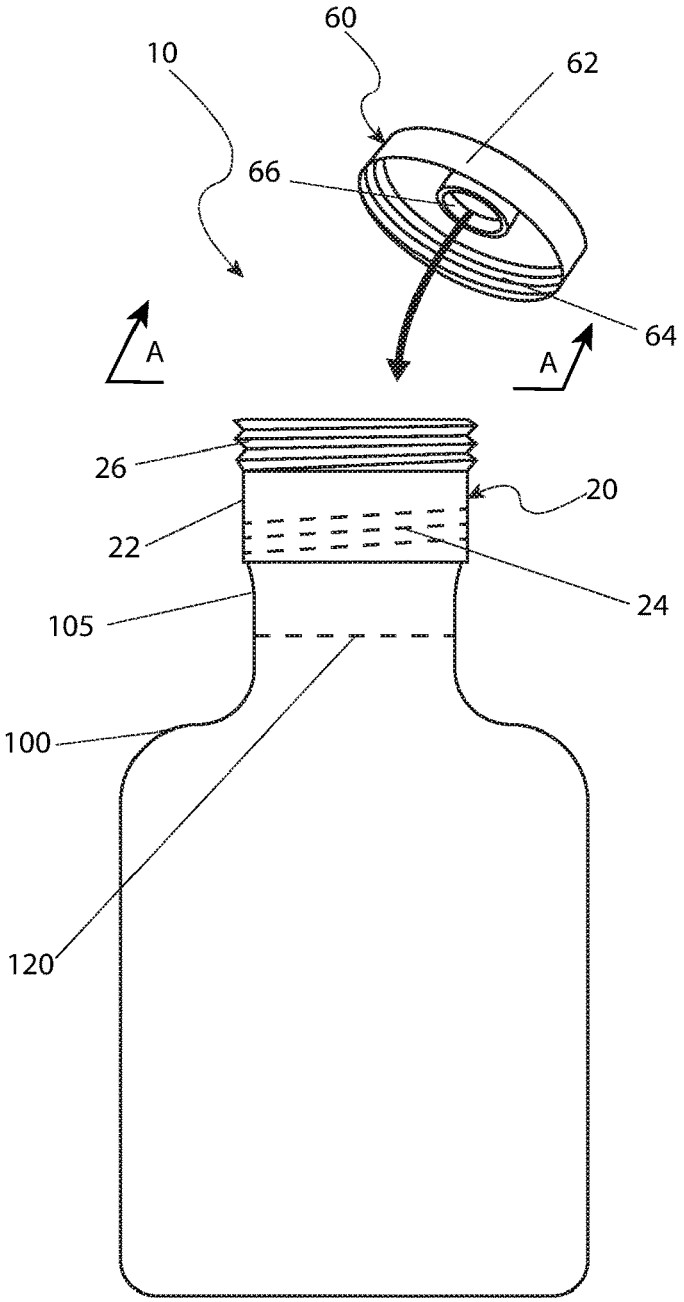
FIG. 1 is a side view of a pouring cap 10, according to a preferred embodiment of the present invention.

10 pouring cap
20 lower lid assembly
22 lower lid body
24 adapter thread
26 exterior thread
28 sealing panel
30 panel aperture
32 upper space
34 lower space
40 valve
42 valve aperture
44 guide pin
46*a* upper stop
46*b* lower stop
60 upper lid assembly
62 upper lid body
64 inner thread
66 appendage
100 existing container
105 container neck
110 container thread
120 contents

DETAILED DESCRIPTION OF THE PREFERRED EMBODIMENT

The present invention describes a pouring cap (herein described as the "device") 10, for attachment to an existing container 100 such as a beverage container or similar vessel, which automatically opens when tilted to dispense the contents 120 of the container 100 such as a liquid beverage or dry granulated materials, and automatically closes when returned to an upright position when finished dispensing the contents 120. The device 10 also includes a sealing upper lid assembly 60.

Figure 2:
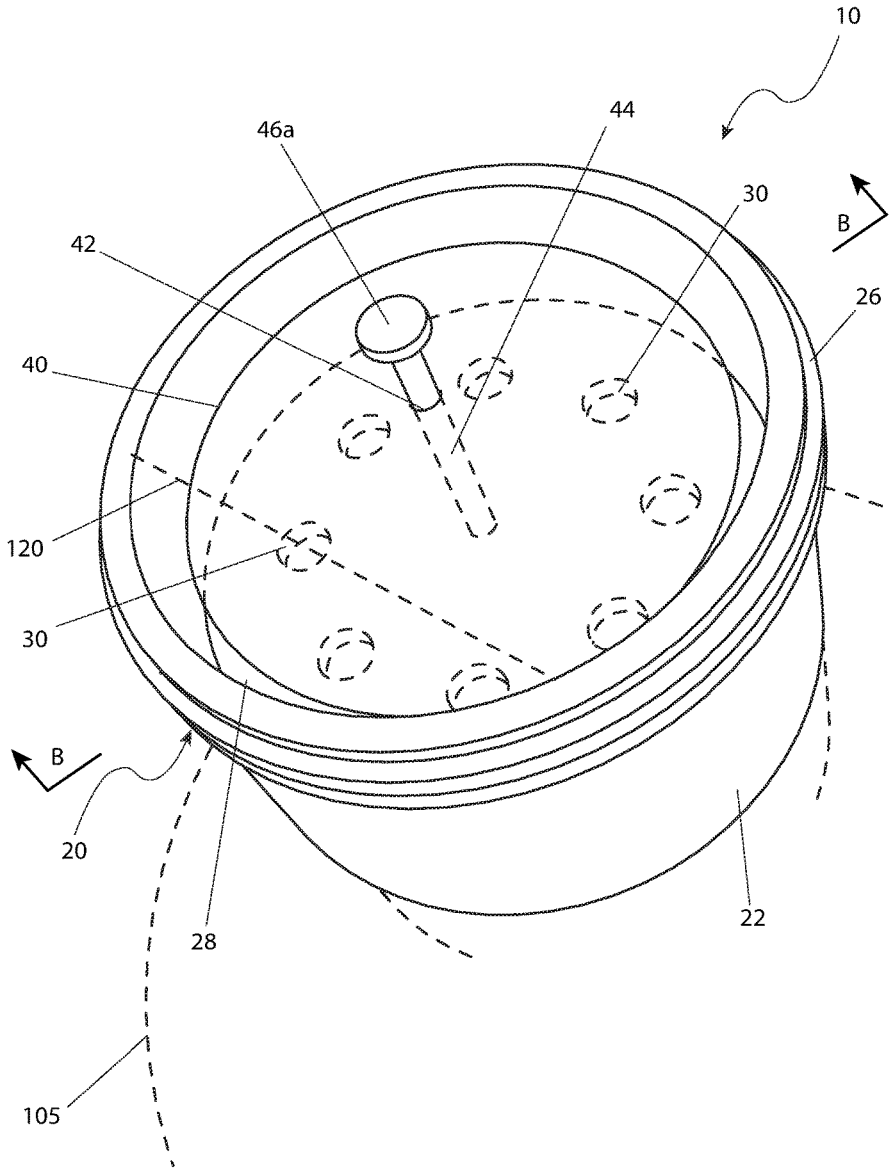
FIG. 2 is an enlarged perspective view of the pouring cap 10, according to a preferred embodiment of the present invention.
Figure 3:
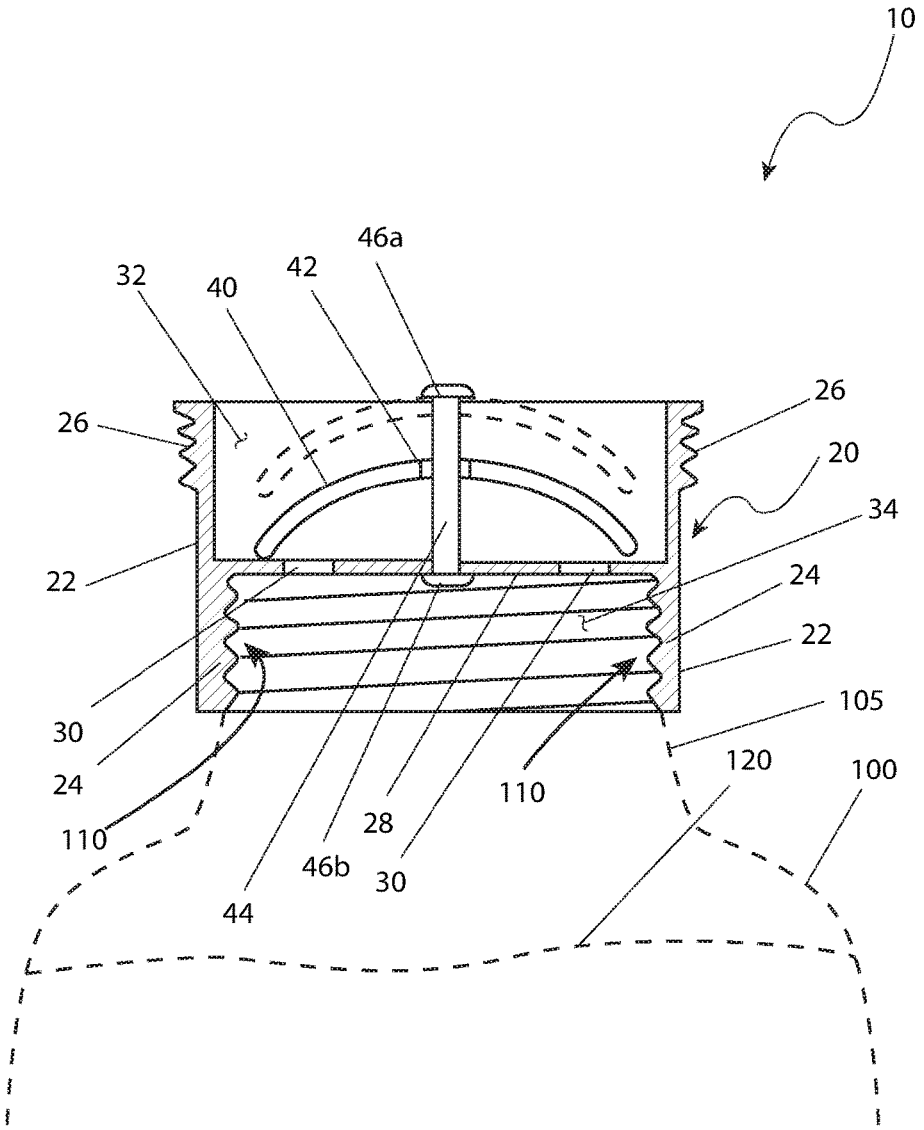
FIG. 3 is a sectional view of the pouring cap 10 taken along section line A-A (see FIG. 1), according to a preferred embodiment of the present invention; and, FIG. 4 is another sectional view of the pouring cap 10 taken along section line B-B (see FIG. 2) depicting installation of an upper lid assembly 60, according to a preferred embodiment of the present invention.

Referring now to FIGS. 1, 2, and 3, side, perspective, and sectional views of the device 10, according to the preferred embodiment of the present invention, are disclosed. The device 10 provides a lower lid assembly 20 and an upper lid assembly 60 preferably made using a plastic material, adapted to be threadingly attached to an existing "wide-mouth" type container 100. The lower lid assembly 20 includes a cylindrical lower lid body 22 having interior adapter threads 24 along an interior circumference adjacent to a bottom edge which provide engagement with container thread portions 110 of the existing container 100. The device 10 is envisioned being introduced having various sized adapter threads 24 to providing adaptation of the device 10 to popular containers 100 having different container threads 110. The lower lid body 22 also includes an exterior threaded portion 26 along an outer circumference adjacent to a top edge which provides a means to attach an upper lid assembly 60 (also see FIG. 4).

The lower lid body 22 includes a bisecting planar sealing panel 28 which splits the lower lid body 22 along a horizontal plane to define an upper space 32 and a lower space 34. The upper space 32 acts as a cylindrical cup during dispensing of the contents 120, and the lower space 34 acts as a receptacle for the container thread portion 110 of the existing container 100. The circular sealing panel 28 includes a plurality of panel apertures 30 being arranged along a circular pattern in an equally-spaced manner to allow the flow of the contents 120 therethrough. The lower lid body 22 also includes a means to attach a valve 40 being capable of stopping a flow of the contents 120 through the panel apertures 30. The valve 40 is located within the upper space 32 and is envisioned to have a dome-shaped construction which, when positioned against a top surface of the sealing panel 28, covers all the panel apertures 30. In use, the position of the valve 40 is acted upon by gravity, being free to slide vertically above the sealing panel 28, when sufficiently tilted, along a guide pin 44 until making contact with an integral "mushroom-shaped" upper stop portion 46*a* of the guide pin 44. The stationary guide pin 44 is mounted to and protrudes perpendicularly from a center of the sealing panel 28 via a press fit connection, and is retained thereto the sealing panel 28 via a "mushroom-shaped" lower stop portion 46*b* being similar to a rivet head. The valve 40 is guided along the guide pin 44 which passes through a valve aperture portion 42 centered upon the valve 40. The position of the valve 40 is effected by gravity and is determined by an orientation of the device 10 and a force applied by the flow of the contents 120. When the device 10 is in an upright and vertical orientation, the valve 40 rests upon the sealing panel 28, sealing in the contents 120. Alternately, when the device 10 is a tilted state such as during drinking or pouring the contents 120, the valve 40 is displaced along the guide pin 44 allowing the contents 120 to flow through the panel apertures 30 from the lower space 34 to the upper space 32, and subsequently dispensed.

The valve 40 is movably connected to the lower lid assembly 20. When the device 10 and attached container 100 are upturned during pouring, the valve 40 moves away from the sealing panel 28 to uncover the panel apertures 30. When the device 10 and container 100 are downturned following pouring, the valve 40 makes contact with the sealing panel 28 to cover the panel apertures 30.

Figure 4:
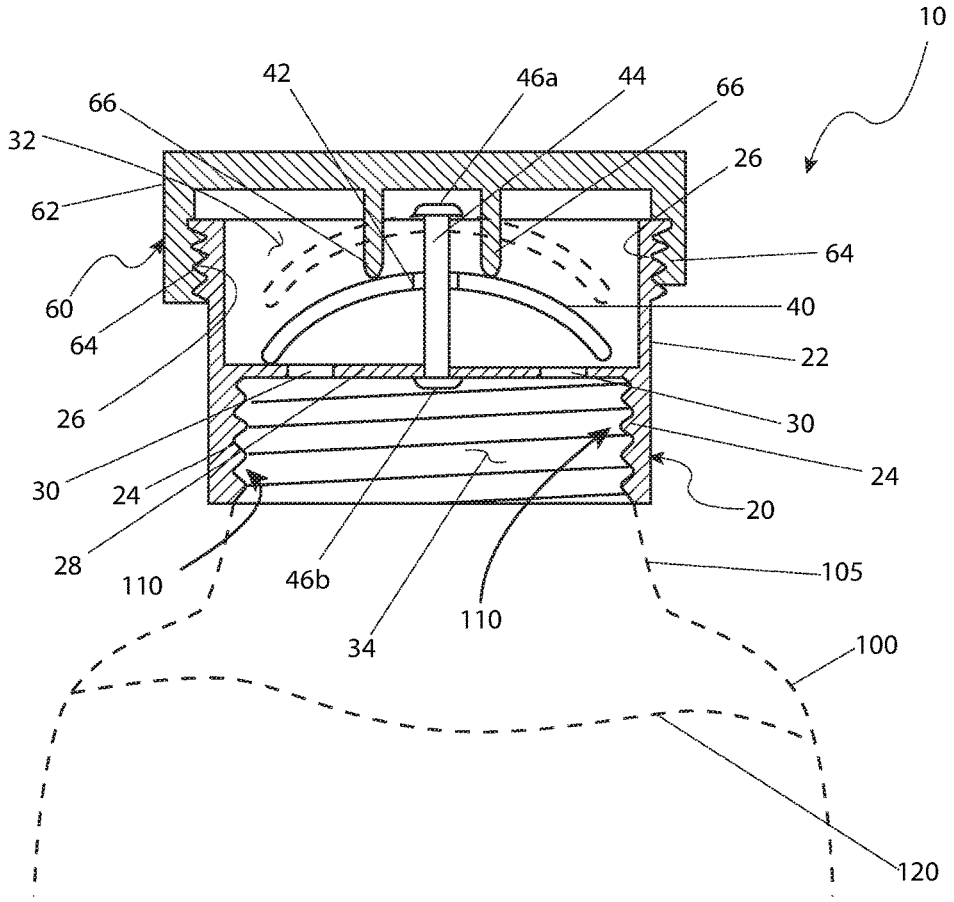

Referring now to FIG. 4, another sectional view of the device 10 taken along section line B-B (see FIG. 2) depicting installation of the upper lid assembly 60, according to a preferred embodiment of the present invention, is disclosed. The outer thread portion 26 of the lower lid assembly 20 provides attachment of the upper lid assembly 60. The upper lid assembly 60 provides a means to cover a top opening portion of the lower lid assembly 20 as well as coincidentally act to lock the valve 40 in a closed and sealed state against the sealing panel 28 regardless of the orientation of the device 10.

The upper lid assembly 60 provides a cylinder-shaped cap member having an open bottom portion which includes inner threads 64 disposed along an interior circumference. The upper lid assembly 60 encloses the open top portion of the lower lid assembly 20 by threadingly engaging the previously described outer thread portion 26 of the lower lid assembly 20. The upper lid 60 provides a means to secure the valve 40 in a closed state via an appendage portion 66. The appendage 66 is an integrally-molded portion of the upper lid assembly 60 being hollow and cylinder-shaped, and being centered along a bottom surface of the upper lid assembly 60. Once the upper lid assembly 60 is installed, the appendage 66 contacts and presses upon a top surface portion of the valve 40 so as to seal it against the sealing panel 28, thereby securing the contents 120 within.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1.

The method of installing and utilizing the device 10 may be achieved by performing the following steps: procuring a model of the device 10 having a desired size adapter thread portion 24 which fits an intended container 100; filling the container 100 with contents 120 such as a beverage or a pourable granulated material, if not previously filled; threadingly installing the upper lid assembly 20 upon the container 10 by engaging the adapter thread portion 24 onto the container thread portion 110 until tight; removing the upper lid assembly 60, if installed; dispensing a portion of the contents 120 by tilting the device 10 until the contents 120 displace the valve 40 in an upward direction along the guide pin 44; dispensing a desired quantity of the contents 120; returning the device 10 and container 100 to their upright position; allowing the valve 40 to return to a position against the sealing panel 28; repeating dispensing of the contents 120 as needed; securing the valve 40 in a locked state by installing the upper lid 60 by engaging the inner thread portion 64 of the upper lid 60 with the exterior thread portion 26 of the lower lid assembly 20 until tight; allowing the appendage portion 66 of the upper lid assembly 60 to press upon and seal against the sealing panel 28 to block the panel apertures 30; and, benefiting from a re-sealable and reusable pouring cap device, afforded a user of the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A cap, comprising:

a lower lid assembly comprising a lower lid body adapted to attach to and in fluid communication with a container opening;

an upper lid assembly attachable to and in fluid communication with said lower lid assembly;

a sealing panel bisecting said lower lid body to define an upper space and a lower space, further having a plurality of apertures providing fluid communication between said upper space and said lower space; and, a valve located within said upper space able to be actuated between a closed position covering each of said plurality of apertures and an open position, enabling fluid communication through said plurality of apertures;

wherein said lower space receives said container opening; and, wherein said lower lid assembly, when attached to said container opening, opens when said container is tilted to enable dispensing of contents within said container and closes when said container is returned to an upright position.

2. The cap of claim 1, wherein said valve further comprises:

a guide pin, having a lower stop portion perpendicularly attached to a center of said sealing panel and an upper stop portion;

a centrally located guide pin aperture permitting said valve to travel along a length of said guide pin;

wherein when said lower lid assembly is attached to said container and said container is tilted downward, said valve is biased away from said sealing panel, thereby uncovering said plurality of apertures and permitting fluid communication between said container and said upper space; and, wherein when said lower lid assembly is attached to said container and said container is tilted upward, said valve entirely covers said plurality of apertures, thereby preventing fluid communication between said container and said upper space.

3. The cap of claim 1, wherein said upper lid assembly further comprises:

an upper lid body; and, an appendage centrally located on an underside of said upper lid body;

wherein when said upper lid assembly is fully attached to said lower lid assembly, said appendage is in mechanical communication with a top surface of said valve thereby sealing said valve in a fixed state over said plurality of apertures.

4. The cap of claim 2, wherein said upper stop portion of said guide pin is mushroom-shaped.

5. The cap of claim 1, wherein said valve is dome-shaped.

6. The cap of claim 1, wherein said lower lid assembly is plastic.

7. The cap of claim 1, wherein said upper lid assembly is plastic.

8. The cap of claim 1, wherein said plurality of apertures is arranged along a circular pattern and are equally spaced.

9. The cap of claim 3, wherein said appendage is an integrally molded portion of the upper lid assembly.

10. A cap, comprising:

a lower lid assembly comprising a lower lid body adapted to threadingly attach to and in fluid communication with a container opening; and, an upper lid assembly threadingly attachable to and in fluid communication with said lower lid assembly;

a sealing panel bisecting said lower lid body to define an upper space and a lower space, further having a plurality of apertures providing fluid communication between said upper space and said lower space; and, a valve located within said upper space able to be actuated between a closed position covering each of said plurality of apertures and an open position, enabling fluid communication through said plurality of apertures;

wherein said lower space receives said container opening; and, wherein said lower lid assembly, when attached to said container opening opens when said container is tilted to enable dispensing of contents within said container and closes when said container is returned to an upright position.

11. The cap of claim 10, wherein said valve further comprises:

a guide pin, having a lower stop portion perpendicularly attached to a center of said sealing panel and an upper stop portion;

a centrally located guide pin aperture permitting said valve to travel along a length of said guide pin;

wherein when said lower lid assembly is attached to said container and said container is tilted downward, said valve is biased away from said sealing panel, thereby uncovering said plurality of apertures and permitting fluid communication between said container and said upper space; and, wherein when said lower lid assembly is attached to said container and said container is tilted upward, said valve entirely covers said plurality of apertures, thereby preventing fluid communication between said container and said upper space.

12. The cap of claim 10, wherein said upper lid assembly further comprises:

an upper lid body; and, an appendage located on an underside of said upper lid body;

wherein when said upper lid assembly is threadingly secured to said lower lid assembly said appendage is in mechanical communication with a top surface of said valve thereby sealing said valve in a fixed state over said plurality of apertures.

13. The cap of claim 11, wherein said upper stop portion of said guide pin is mushroom-shaped.

14. The cap of claim 10, wherein said valve is dome-shaped.

15. The cap of claim 10, wherein said lower lid assembly is plastic.

16. The cap of claim 10, wherein said upper lid assembly is plastic.

17. The cap of claim 10, wherein said plurality of apertures is arranged along a circular pattern and equally spaced.

18. The cap of claim 12, wherein said appendage is an integrally molded portion of the upper lid assembly.

* * * * *